US008699890B2

(12) United States Patent
Okamoto

(10) Patent No.: US 8,699,890 B2
(45) Date of Patent: Apr. 15, 2014

(54) IMAGE FORMING AGENT STORAGE CONTAINER, IMAGE FORMING APPARATUS, METHOD OF MOUNTING IMAGE FORMING AGENT STORAGE CONTAINER, METHOD OF REMOVING IMAGE FORMING AGENT STORAGE CONTAINER, AND METHOD OF FILLING IMAGE FORMING AGENT

(75) Inventor: Masaya Okamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 571 days.

(21) Appl. No.: 12/721,294

(22) Filed: Mar. 10, 2010

(65) Prior Publication Data

US 2010/0232813 A1 Sep. 16, 2010

(30) Foreign Application Priority Data

Mar. 11, 2009 (JP) ..... 2009-057988

(51) Int. Cl.
*G03G 15/00* (2006.01)
*G03G 15/08* (2006.01)

(52) U.S. Cl.
USPC ..... 399/12; 399/262

(58) Field of Classification Search
USPC ..... 399/12, 258, 262
See application file for complete search history.

(56) References Cited

U.S. PATENT DOCUMENTS

2005/0123322 A1 6/2005 Okamoto et al.

FOREIGN PATENT DOCUMENTS

| | | | |
|---|---|---|---|
| CN | 1624598 | A | 6/2005 |
| JP | 04-115272 | A | 4/1992 |
| JP | 2001-281947 | A | 10/2001 |
| JP | 2001-350338 | A | 12/2001 |
| KR | 10-0542359 | B1 | 1/2006 |

OTHER PUBLICATIONS

Asada (JP 2001-350338, Dec. 2001) JPO Machine Translation.*
Japanese Office Action for Application No. 2009-057988, dated May 8, 2009.
U.S. Appl. No. 12/721,281 by Kazunori Koshi Mori, filed Mar. 10, 2010.
U.S. Appl. No. 12/721,277 by Masaya Okamoto, filed Mar. 10, 2010.
Office Action, dated Feb. 27, 2013, issued by the State Intellectual Property Office of P.R. China in counterpart Chinese Patent application No. 201010116153.4.
Office Action dated May 15, 2013 issued by the Korean Intellectual Property Office in corresponding Korean Patent Application No. 10-2010-0010642.

* cited by examiner

*Primary Examiner* — David Gray
*Assistant Examiner* — Erika J Villaluna
(74) *Attorney, Agent, or Firm* — Sughrue Mion, PLLC

(57) ABSTRACT

An image forming agent storage container includes a container body and at least two container-side protruding portions. The container body is configured to be detachably attached in an image forming apparatus body. The container body forms a storage chamber in which an image forming agent is stored. At least two container-side protruding portions protrude toward an outside of the container body and have cavities on a storage-chamber side thereof. The cavities are configured to store the image forming agent. The at least two container-side protruding portions are configured so that a body-side protruding portion is formed on the image forming apparatus body is fitted between the at least two container-side protruding portions, which are adjacent to each other.

15 Claims, 15 Drawing Sheets

IMAGE FORMING AGENT STORAGE CONTAINER, IMAGE FORMING APPARATUS, METHOD OF MOUNTING IMAGE FORMING AGENT STORAGE CONTAINER, METHOD OF REMOVING IMAGE FORMING AGENT STORAGE CONTAINER, AND METHOD OF FILLING IMAGE FORMING AGENT

CROSS-REFERENCE TO RELATED APPLICATIONS

This application is based on and claims priority under 35 USC 119 from Japanese Patent Application No. 2009-57988 filed Mar. 11, 2009.

BACKGROUND

Technical Field

The present invention relates to an image forming agent storage container, an image forming apparatus, a method of mounting the image forming agent storage container, a method of removing the image forming agent storage container, and a method of filling an image forming agent.

SUMMARY

According to an aspect of the invention, an image forming agent storage container includes a container body and at least two container-side protruding portions. The container body is configured to be detachably attached in an image forming apparatus body. The container body forms a storage chamber in which an image forming agent is stored. At least two container-side protruding portions protrude toward an outside of the container body and have cavities on a storage-chamber side thereof. The cavities are configured to store the image forming agent. The at least two container-side protruding portions are configured so that a body-side protruding portion is formed on the image forming apparatus body is fitted between the at least two container-side protruding portions, which are adjacent to each other.

BRIEF DESCRIPTION OF THE DRAWINGS

Exemplary embodiments of the invention will be described below based on the accompanying drawings, wherein:

FIG. 7A is a side view showing a state where the operating member is in a first position, FIG. 7B is a side view showing a state where the operating member is in a second position.

FIGS. 8A to 8C illustrate the movement of the operating member of the storage container according to the exemplary embodiment of the invention, and specifically, FIG. 8A is a section view showing a state where the operating member is in the first position, FIG. 8B is a section view showing a state where the operating member is in the second position, and FIG. 8C is a section view showing a state where the operating member is in the third position;

FIG. 15A is a right side view showing the storage container in a state where the operating member is arranged in the second position, and FIG. 15B is a view showing the right side face of the storage container, and a cross-section of the mounting device;

DETAILED DESCRIPTION

Hereinafter, exemplary embodiments of the invention will be described with reference to the accompanying drawings.

Figure 1:
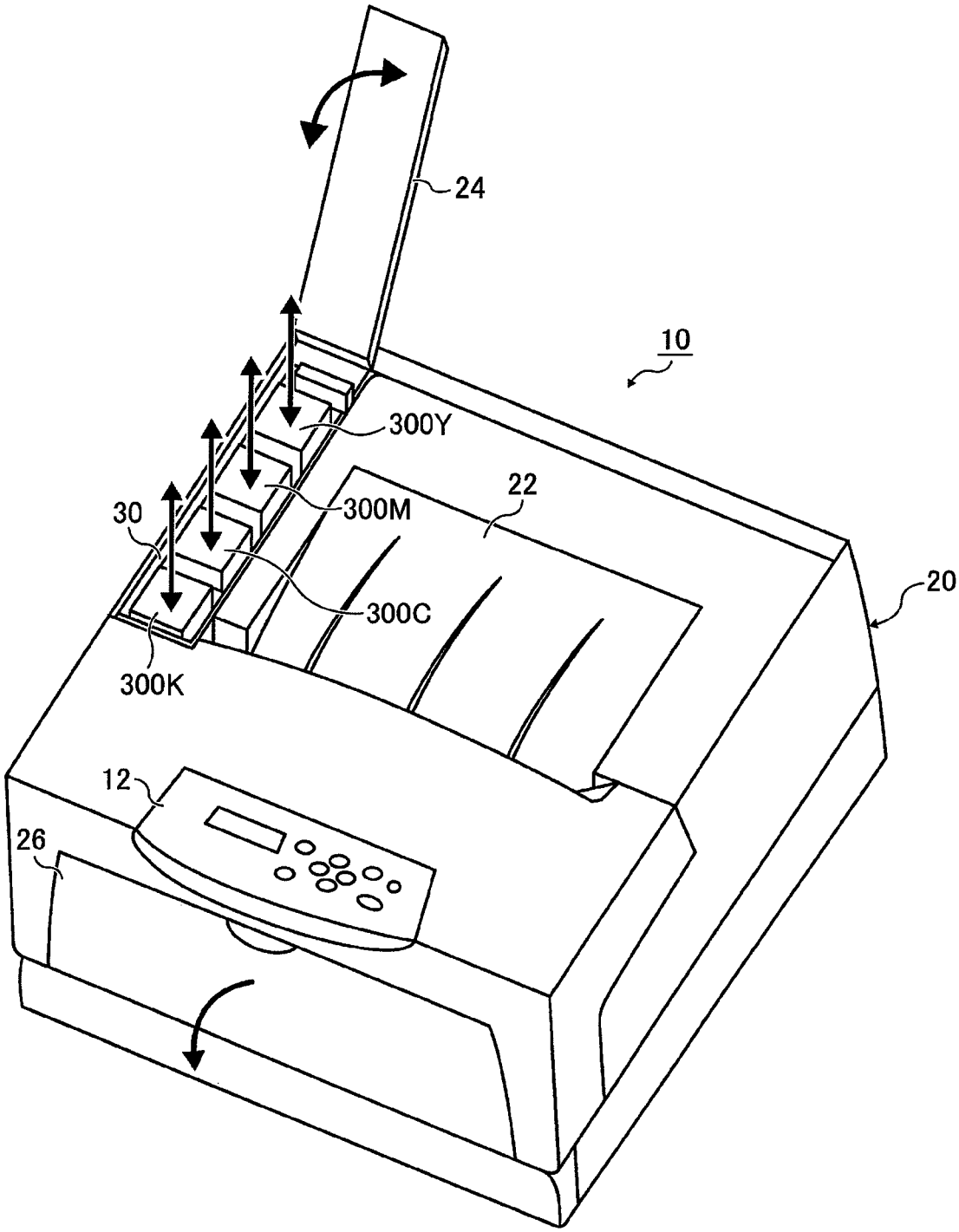
FIG. 1 is a perspective view showing an image forming apparatus according to an exemplary embodiment of the invention.

FIG. 1 shows an image forming apparatus 10 according to the exemplary embodiment of the invention. As shown in FIG. 1, the image forming apparatus 10 has an image forming apparatus body 20, and an upper part of the image forming apparatus body 20 is used as a discharge part 22 from which a paper on which an image has been formed is discharged. Also, an operation panel 12 used as an operation device is mounted to a front side of the image forming apparatus body 20.

A mounting opening and closing part 24, and a paper-feed opening and closing part 26 are mounted to the image forming apparatus body 20 so that each of them can be opened and closed. The mounting opening and closing part 24 is opened when storage containers 300Y, 300M, 300C, and 300K used image forming agent storage containers are mounted to the image forming apparatus body 20, and is opened when the storage containers 300Y, 300M, 300C, and 300K are detached from an inside of the image forming apparatus body 20. The mounting opening and closing part 24 is closed when image formation is performed. The paper-feed opening and closing part 26 is opened when papers on which images are to be formed are supplied from the front side of the image forming apparatus body 20. Also, the mounting opening and closing part 24 is opened and closed in a manner of rotating the mounting opening and closing 24 with the rear of the image forming apparatus body 20 in FIG. 1 used as a fulcrum (in such a manner that a fulcrum is formed on a short side of the mounting opening and closing part 24). However, this is not limited to the configuration of FIG. 1. The mounting opening and closing part 24 may be opened and closed in a manner of rotating the mounting opening and closing part 24 with a side of the image forming apparatus body 20 used as a fulcrum (in such a manner that a fulcrum is formed on a long side of the mounting opening and closing part 24). Also, a mounting device 30 on which the storage containers 300Y, 300M, 300C, and 300K are to be mounted is provided in the image forming apparatus body 20.

Yellow toner, magenta toner, cyan toner, and black toner used as image forming agents are respectively stored in the storage containers 300Y, 300M, 300C, and 300K. The storage containers 300Y, 300M, and 300C have the same shape and size, and are configured to be able to store the same capacity of toner. The storage container 300K is configured so as to be vertically longer than the storage containers 300Y, 300M, and 300C, and has a larger volume than the storage containers 300Y, 300M, and 300C, with a larger capacity that stores more toner than the storage containers 300Y, 300M, and 300C.

The storage containers 300Y, 300M, and 300C have different toner capacity from the storage container 300K, but have the same members and functions. Hereinafter, except for the case where a specific storage container is shown, the storage containers 300Y, 300M, 300C, and 300K will be collectively referred to as the storage container 300.

Figure 2:
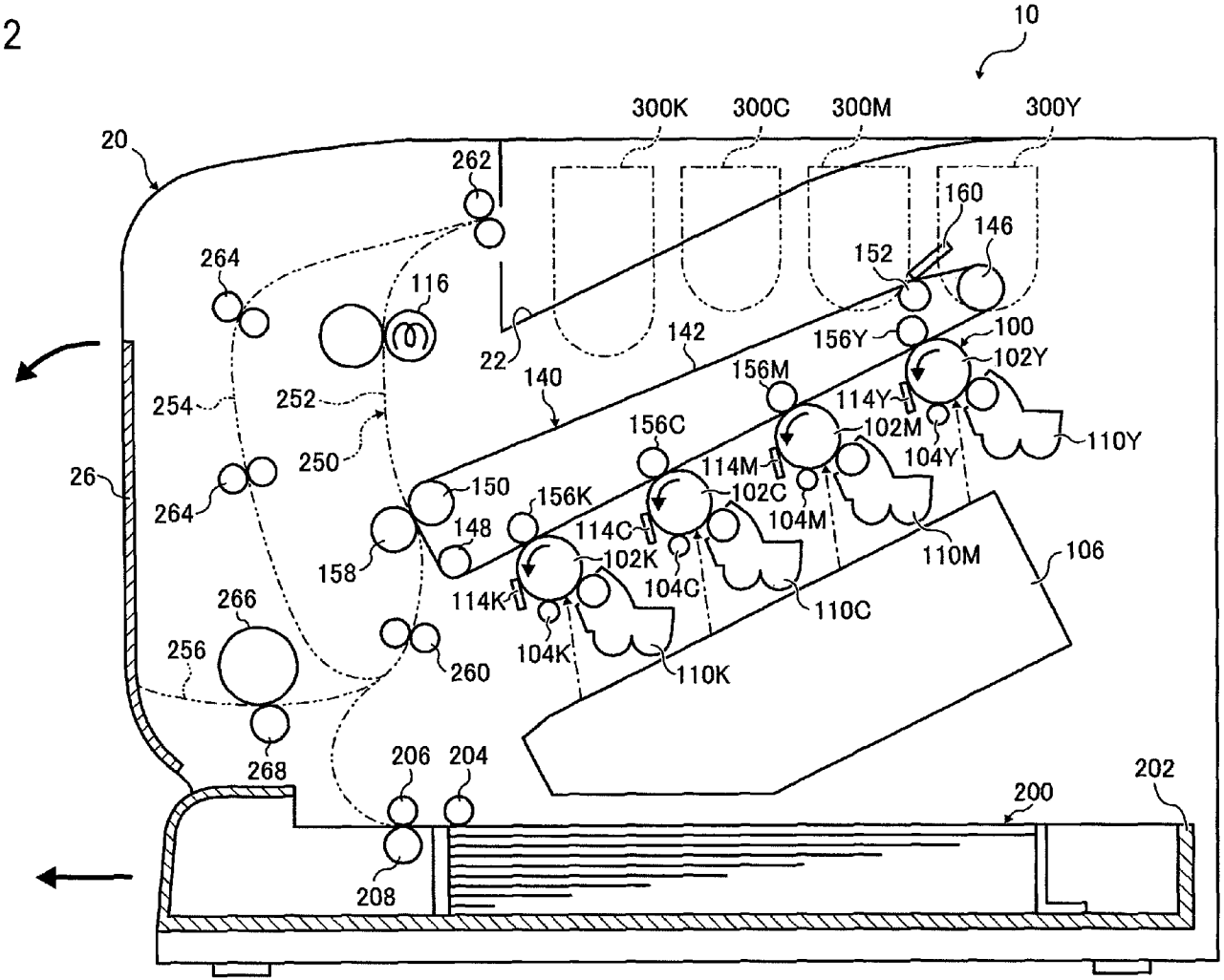
FIG. 2 is a side perspective view showing the image forming apparatus according to the exemplary embodiment of the invention.
Figure 3:
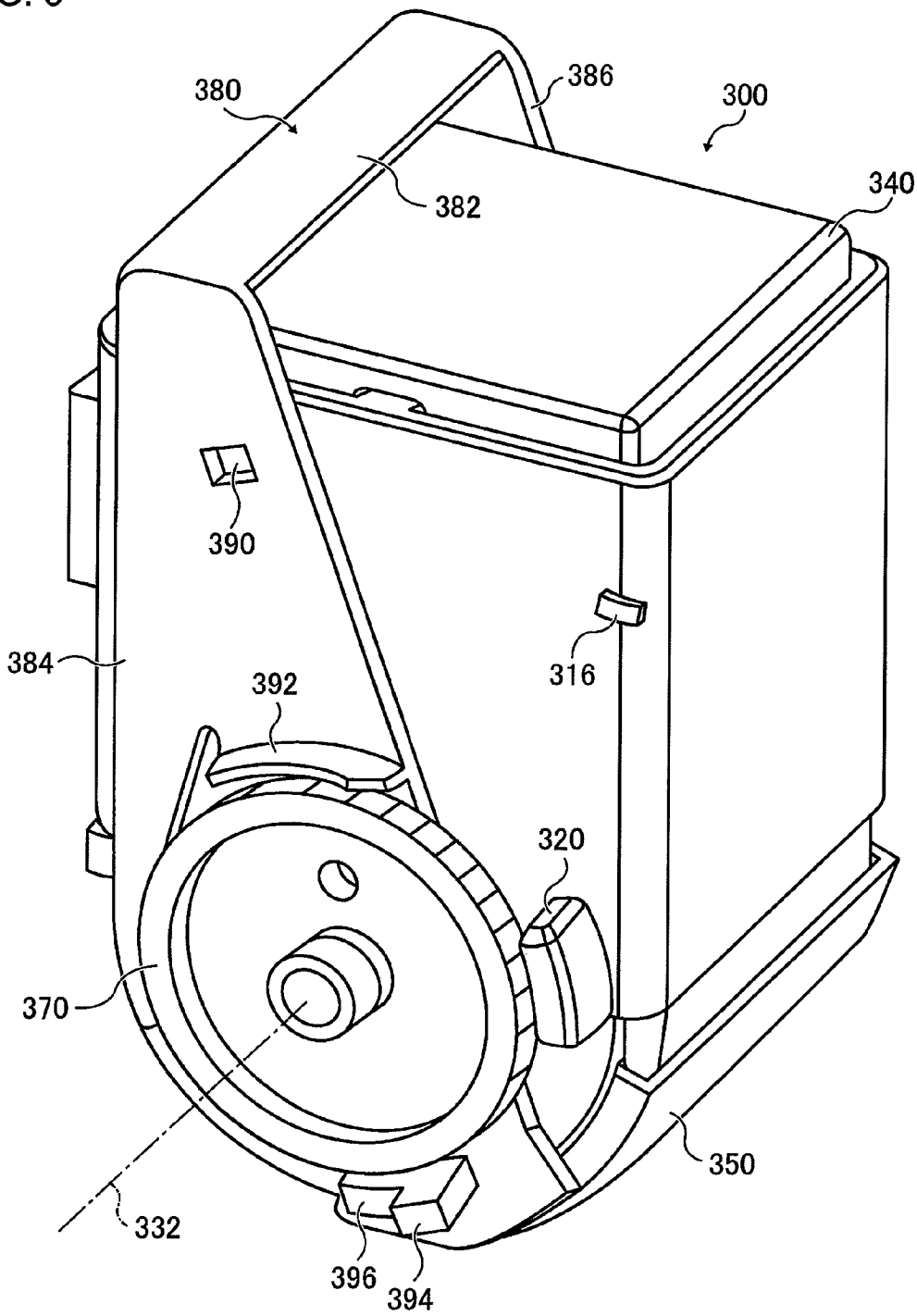
FIG. 3 is a first perspective view showing a storage container according to the exemplary embodiment of the invention.
Figure 4:
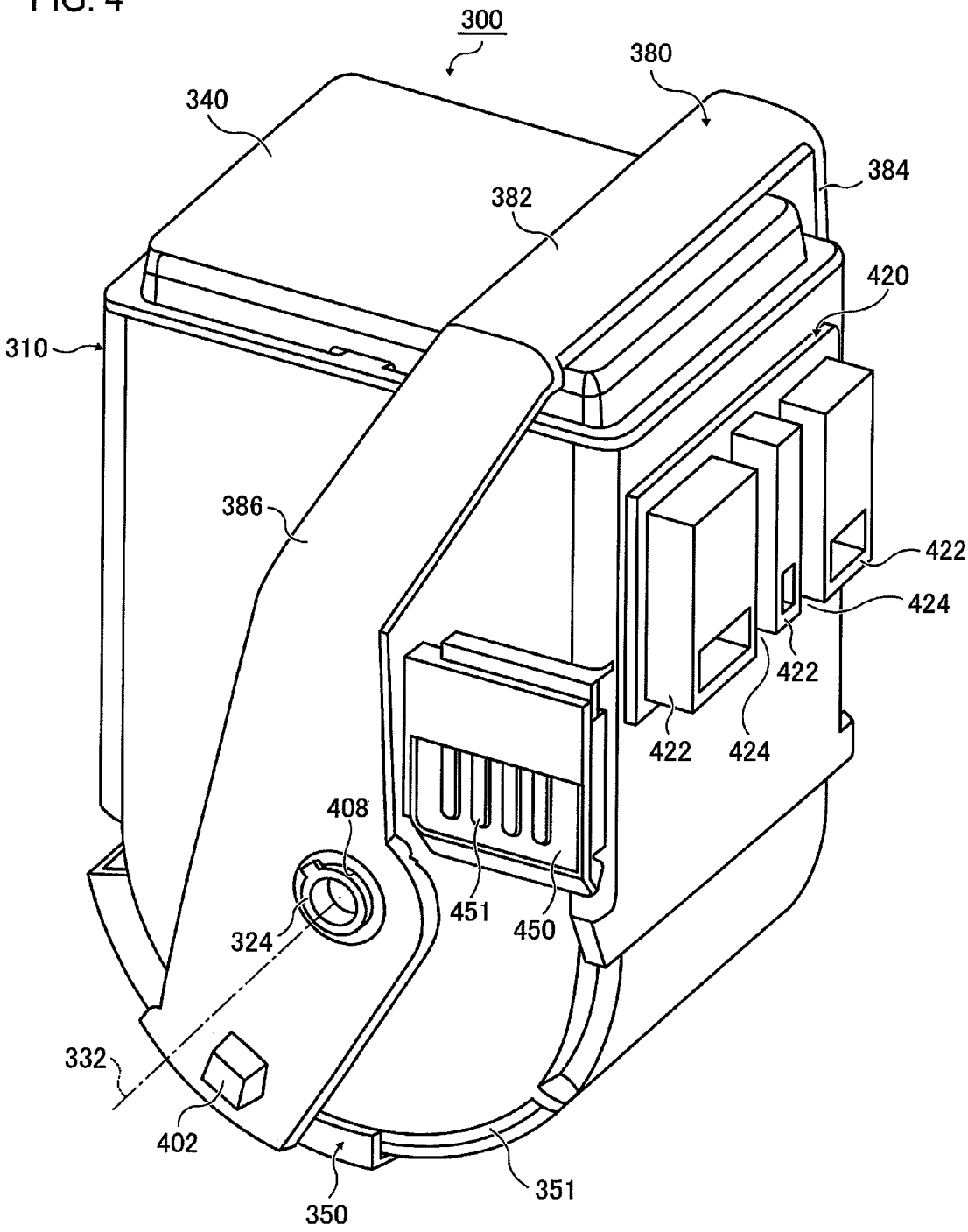
FIG. 4 is a second perspective view showing the storage container according to the exemplary embodiment of the invention.
Figure 5:
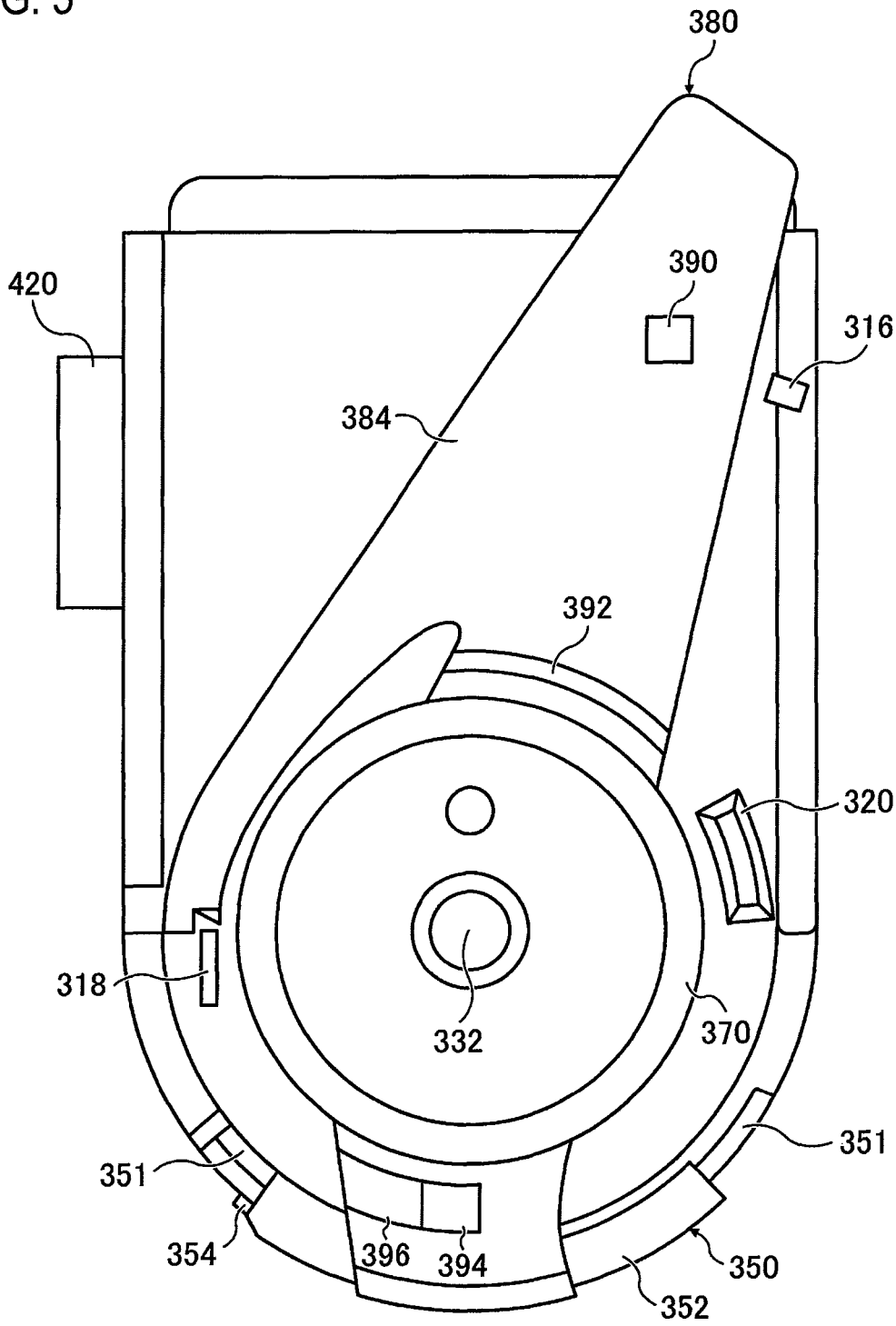
FIG. 5 is a side view showing the storage container according to the exemplary embodiment of the invention.

FIG. 2 is a section of the image forming apparatus 10.

As shown in FIG. 2, an image forming part 100 and a paper feeder 200 which supplies papers to the image forming part 100 are mounted to the image forming apparatus body 20. Also, a conveyance path 250 used for conveyance of papers is formed in the image forming apparatus body 20.

The image forming part 100 has photosensitive drums 102Y, 102M, 102C, and 102K used as image carriers, charging devices 104Y, 104M, 104C, and 104K which respectively charge the photosensitive drums 102Y, 102M, 102C, and 102K, a latent image forming device 106 which emit light onto the photosensitive drums 102Y, 102M, 102C, and 102K charged by the charging devices 104Y, 104M, 104C, and 104K to form electrostatic latent images, and developing devices 110Y, 110M, 110C, and 110K which develop electrostatic latent images, which have been formed on the surfaces of the photosensitive drums 102Y, 102M, 102C, and 102K by the latent image forming device 106, using toner to form a yellow toner image, a magenta toner image, a cyan toner image, and a black toner image.

Yellow toner, magenta toner, cyan toner, and black toner are supplied to the developing devices 110Y, 110M, 110C, and 110K, respectively from the storage containers 300Y, 300M, 300C, and 300K.

Also, the image forming part 100 has a transfer device 140 which transfers to a paper the yellow toner image, the magenta toner image, the cyan toner image, and the black toner image, which have respectively been formed by the developing devices 110Y, 110M, 110C, and 110K. The image forming part 100 also has cleaning devices 114Y, 114M, 114C, and 114K which clean the surfaces of the photosensitive drums 102Y, 102M, 102C, and 102K, and a fixing device 116 which fixes the toner images transferred by the transfer device 140 to the paper.

The transfer device 140 has a belt-like intermediate transfer body 142 to which the yellow toner image, the magenta toner image, the cyan toner image, and the black toner image, which have been formed on the photosensitive drums 102Y, 102M, 102C, and 102K, are transferred so as to overlap each other, and which is used as a transfer medium. The intermediate transfer body 142 is supported by supporting rollers 146, 148, 150, and 152 so as to be rotatable.

Also, the transfer device 140 has primary transfer rollers 156Y, 156M, 156C, and 156K used as primary transfer devices which transfer to the intermediate transfer body the yellow toner image, the magenta toner image, the cyan toner image, and the black toner image, which have respectively been formed on the photosensitive drums 102Y, 102M, 102C, and 102K, and a secondary transfer roller 158 used as a secondary transfer device which transfers to a paper the yellow toner image, the magenta toner image, the cyan toner image, and the black toner image, which have been transferred to the intermediate transfer body 142. Also, the transfer device 140 has a cleaning device 160 which cleans the surface of the intermediate transfer body 142.

The paper feeder 200 has, for example, a paper housing part 202 which uses a cassette, an extraction roller 204 for extracting paper which is located at the uppermost position and which is housed in the paper housing part 202, a conveying roller 206 which conveys the paper extracted by the extraction roller 204 toward the image forming part 100, and a separating roller 208 which comes into contact with the conveying roller 206 and separates papers between the separating roller and the conveying roller 206. The paper housing part 202 is configured to be able to be pulled out, for example, to the front side (the left side in FIG. 2) of the image forming apparatus body 20, and papers are replenished into the paper housing part 202 in a state where the paper housing part has been pulled out from the image forming apparatus body 20.

The conveyance path 250 has a main conveyance path 252, a reverse conveyance path 254, and an auxiliary conveyance path 256.

The main conveyance path 252 is a conveyance path which conveys a paper supplied from the paper feeder 200 toward the discharge part 22, and is mounted with a registration roller 260, the secondary transfer roller 158, the fixing device 116, and a discharge roller 262 in order from the upstream side in a paper conveying direction, along the main conveyance path 252. The registration roller 260 starts its rotation at a predetermined timing from a stopped state, and supplies a paper to a contact portion between the intermediate transfer body 142 and the secondary transfer roller 158 so as to match the timing at which a toner image is transferred to the intermediate transfer body 142.

A discharge roller 262 discharges the paper on which the toner image is fixed by the fixing device 116 to the discharge part 22. Also, when images are to be formed on both faces of a paper, the discharge roller 262 rotates in a direction opposite to a direction for the case where a paper is discharged to the discharge part 22, and supplies the paper on which an image is formed on one surface thereof to the reverse conveyance path 254 from its rear end side.

The reverse conveyance path 254 is used when the paper one surface of which an image is formed on is again supplied to the upstream of the registration roller 260 while the paper is inverted. Two reverse conveying rollers 264 and 264 are mounted along the reverse conveyance path 254.

The auxiliary conveyance path 256 is a conveyance path used when a paper is supplied from the front side of the image forming apparatus body 20 in a state where the paper-feed opening and closing part 26 is opened with respect to the image forming apparatus body 20. An auxiliary conveying roller 266 which conveys a paper toward the registration roller 260, and a separating roller 268 which is used to contact with the auxiliary conveying roller 266 so as to separate the papers, are mounted along the auxiliary conveyance path 256.

FIGS. 3 to 6 show the storage container 300.

As described above, the respective storage containers 300Y, 300M, and 300C have the same shape and size, and the storage container 300K has a larger capacity than the storage containers 300Y, 300M, and 300C. FIGS. 3 to 6 show the storage container 300 used as the storage containers 300Y, 300M, and 300C.

As shown in FIGS. 3 to 6, the storage container 300 has a container body 310, an opening and closing part 350, an operating member 380 used as an operating part, and a gear 370 used as a drive transmission part.

The storage container 300 is detachably mounted in the image forming apparatus body 20 and constitutes a storage chamber 302 which stores the image forming agent. The storage container 300 is formed with a discharge hole 312 in a position which is a lower side relative to the direction of gravity in a state where the storage container 300 is mounted to the image forming apparatus body 20 (see FIG. 1). The toner discharged from the discharge hole 312 is supplied to the developing device 110 and is used for image formation. Also, the container body 310 is formed with a filling hole 314, which is used to fill toner into the container body 310, in a position which is in an upward direction relative to the direction of gravity in the state where the storage container 300 is mounted to the image forming apparatus body 20. The filling hole 314 is formed over substantially the whole region in the upward face of the container body 310, and toner is filled into the container body 310 via the filling hole 314 in such a manner that the toner is dropped from above in the direction of gravity. The shape of the filling hole 314 when viewed from above in the direction of gravity is substantially a rectangular shape. Therefore, the shape of the upward face of the container body 310 when viewed from above in the direction of gravity is also substantially a rectangular shape.

Also, a fixing projection 316 is formed on a front face of the container body 310 so as to project toward the front side. The fixing projection 316 is used as a fixing member which fixes the operating member 380 to a third position which will be described later.

Also, a prohibiting projection 318 is formed on a front-side side face of the container body 310 so as to project toward the front side. The prohibiting projection 318 is used as a movement prohibiting member which prohibits the operating member 380 from moving from a second position which will be described later to a first position which will be described later. Also, the prohibiting projection 318 is used as an opening prohibiting member which prohibits the discharge hole 312 from being opened in a state where the container body 310 is not mounted to the image forming apparatus body 20.

Also, a protecting projection 320 is formed in a position on the front side of the container body 310 and near the gear 370, so as to project toward the front side. The protecting projection 320 makes it difficult for a face of the gear 370 on which teeth are formed to collide with other objects, thereby protecting the gear 370.

A stirring device 330 used as a stirring part for stirring the toner stored in the container body 310 is mounted to the inside of the container body 310. The stirring device 330 has a shaft 332 attached to the container body 310 so as to be rotatable about a rotary axis 332, a parallel part 334 which is attached to the shaft 322 and is substantially parallel to the shaft 322, and a stirring plate 336 which is attached to the shaft 322. The stirring plate 336 is made of an elastic film-like sheet, and is configured so that its distal end comes into contact with an internal face of the container body 310.

Also, a cylindrical-shaped supporting projection 324, which is used to rotatably support the operating member 380, is formed on a rear face of the container body 310. Also, a supporting projection (not shown), which is used to rotatably support the operating member 380, is formed on the front face of the container body 310 similarly to the supporting projection 324.

Figure 6:
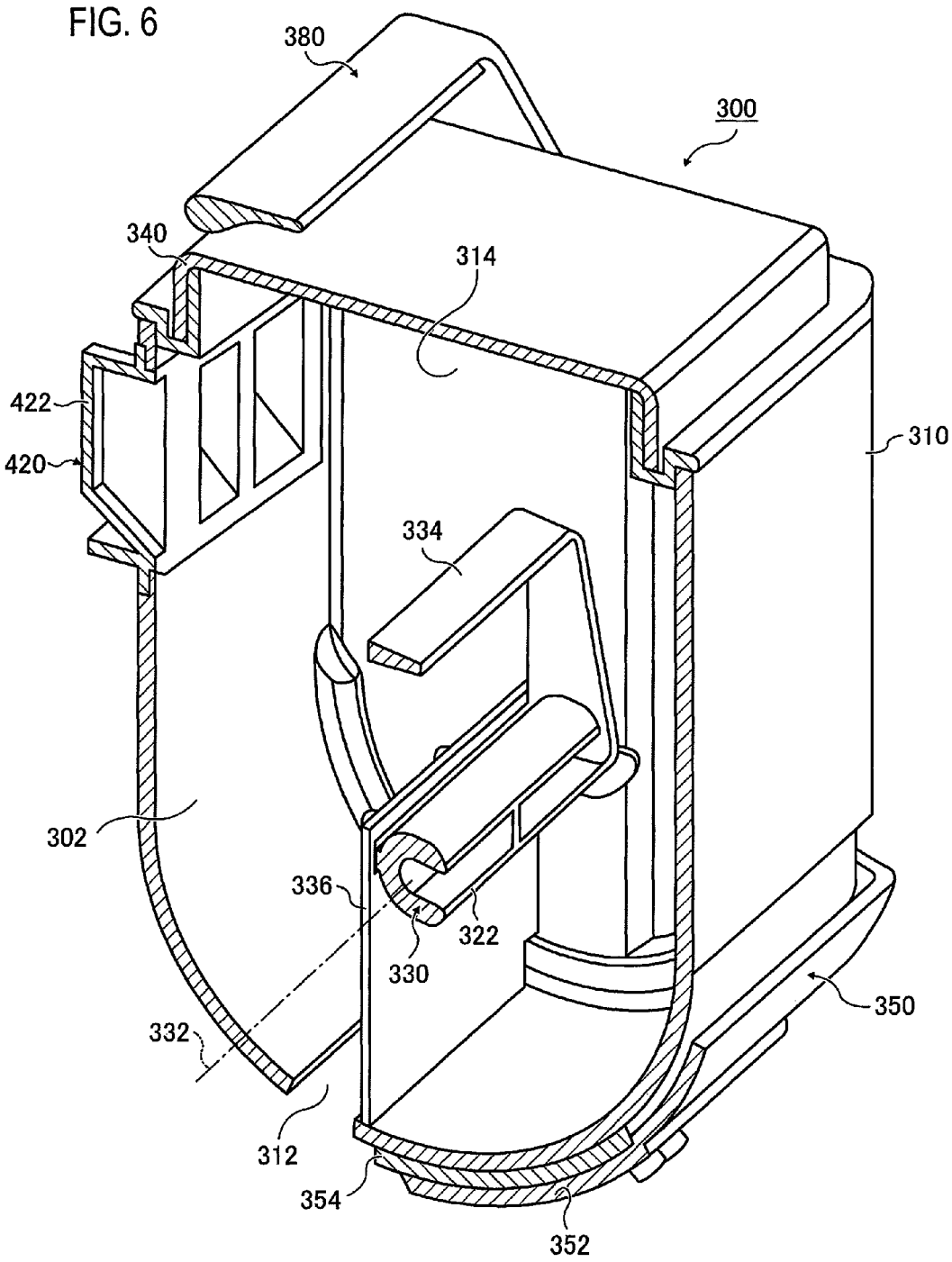
FIG. 6 is a side view showing a section of the storage container according to the exemplary embodiment of the invention.

Also, as shown in FIG. 6, the stirring device 330 may be arranged so that its longitudinal direction is coincide with a vertical direction that is a direction in which toner is filled into the container body 310 via the filling hole 314. If the toner is filled into the container body 310 in a state where the stirring device 330 is arranged in such a position, the downward movement of the toner from above is hardly hindered by the stirring device 330, and the toner can be effectively stored in the container body 310 elongating in the vertical direction.

Also, a protruding portion forming member 420 is formed on a left side of the container body 310. Container-side protruding portions 422 are constituted by the protruding portion forming member 420 so as to protrude toward an outside of the container body 310. The protruding portion forming member 420 and the container-side protruding portions 422 will be described below in detail.

Also, a storage medium 450 used as a storage device is mounted to the rear face of the container body 310 so as to be detachable from the container body 310. The storage medium 450 can be connected with a data writing device (not shown) provided on the image forming apparatus body 20, and data, such as the number of images formed with the toner stored in the storage container 300, from the data writing device is written therein. Connecting terminals 451 of the storage medium 450 extend so as to be long in the vertical direction, and are provided so that their lower portions including the lower ends in the vertical direction are exposed, and four connecting terminals are provided in the right-and-left horizontal direction. As described later in detail, in the state of FIG. 4 where the opening and closing part 350 connected with the operating member 380 closes the discharge hole 312 (a state where the operating member 380 is in the second position), a lower portion (on the opening-and-closing-part-350 side) of a rear arm portion 386 of the operating member 380 retreats from the lower portions of the connecting terminals of the storage medium 450.

The opening and closing part 350 is attached so as to be movable to a lower position of the container body 310. As the opening and closing part 350 moves with respect to the container body 310, the discharge hole 312 is brought into an opened state or is brought into a closed state. The opening and closing part 350 has an opening and closing member 352 which is mounted so as to be movable with respect to the container body 310, and a sealing member 354 which is provided between the opening and closing member 352 and the container body 310 and is used to seal the discharge hole 312.

The operating member 380 has a facing portion 382 which is arranged in a position which faces the filling hole 314, a front arm portion 384 which extends from a front end of the facing portion 382, and the rear arm portion 386 which extends from a rear end of the facing portion 382. A through hole (not shown) is formed in the front arm portion 384 so that the supporting projection (not shown) formed on the front side of the container body 310 fits thereinto. A through hole 408 is formed in the rear arm portion 386 so that the supporting projection 324 formed on the rear face of the container body 310 fits thereinto.

The supporting projection formed in the front face of the container body 310 is inserted into the through hole formed in the front arm portion 384, and the supporting projection 324 is inserted into the through hole 408. Thereby, the operating member 380 is supported so as to be rotatable about the rotary axis 332, and can be moved between a first position, the second position, and the third position, which will be described later.

A through hole 390 is formed in the front arm portion 384. The through hole 390 is formed in a position where the fixing projection 316 fits thereinto in a state where the operating member 380 is arranged in the third position, which will be described later. For this reason, the operating member 380 is fixed by the through hole 390 and the fixing projection 316 to the third position with respect to the container body 310.

Also, a protecting projection 392 is formed in the front arm portion 384 so as to be located above the gear 370. The protecting projection 392 protects a face of the gear 370 on which teeth are formed, and keeps an operator from touching the gear 370 in a state where the storage container 300 is mounted to the image forming apparatus body 20.

Also, a guiding projection 394 is formed at the lower end of the front arm portion 384 and on a distal end side of the storage container 300 in a direction in which the storage container 300 is inserted into the image forming apparatus body 20. The guiding projection 394 is fitted into a guide groove (not shown in the figures) formed on the image forming apparatus body 20, and guides the mounting of the storage container 300 into the image forming apparatus body 20 and removing of the storage container 300 out of the image forming apparatus body 20.

Also, a collision suppressing projection 396 is formed with continuing to, for example, the guiding projection 394, at the lower end of the front arm portion 384 and on the distal end in the direction in which the storage container 300 is inserted into the image forming apparatus body 20. The collision suppressing projection 396 makes it difficult for the face of the gear 370 on which the teeth are formed to collide with the image forming apparatus body 20 when the storage container 300 is being inserted into the image forming apparatus body 20. Similarly to the collision suppressing projection 396, the guiding projection 394 has a function of making it difficult for the face of the gear 370 on which the teeth are formed to collide with the image forming apparatus body 20.

A guiding projection 402 is formed on the lower end side of the rear arm portion 386 similarly to the fact that the guiding projection 394 is formed on the front arm portion 384. The guiding projection 402 is fitted into a guide groove 44 (see FIG. 14) formed on the image forming apparatus body 20, and guides attachment and detachment of the storage container 300 into and from the image forming apparatus body 20.

The operating member 380 and the opening and closing member 352 are connected with each other. That is, a portion of the front arm portion 384 on the lower end side thereof is connected with the front portion of the opening and closing member 352, and a portion of the rear arm portion 386 on the lower end thereof is connected with the rear portion of the opening and closing member 352. Therefore, the operating member 380 moves in conjunction with movement of the opening and closing member 352.

The gear 370 is mounted to the front face of the container body 310, and when the storage container 300 is mounted to the image forming apparatus body 20, the gear 370 is connected with a gear (not shown) provided on the image forming apparatus body 20 so as to receive a driving transmission force from this gear. Also, the gear 370 is connected with a portion of the axis 332, which projects out of the container body 310. Therefore, when a driving force is transmitted so as to rotate the gear 370, the stirring device 330 is rotated within the container body 310, and the toner stored within the container body 310 is stirred.

The storage container 300 has the lid member 340, which is used as a sealing part for sealing the filling hole 314, as well as the container body 310, the opening and closing part 350, the operating member 380, and the gear 370. The lid member 340 is mounted to the container body 310 so as to fit into the filling hole 314 after the toner is filled into the container body 310 via the filling hole 314. When the lid member 340 is mounted, the filling hole 314 is sealed, and the toner is prevented from spilling out from the filling hole 314 irrespective of the direction of the container body 310.

FIGS. 7A to 7C and 8A to 8C explain an operation of the operating member 380.

Figure 7A:
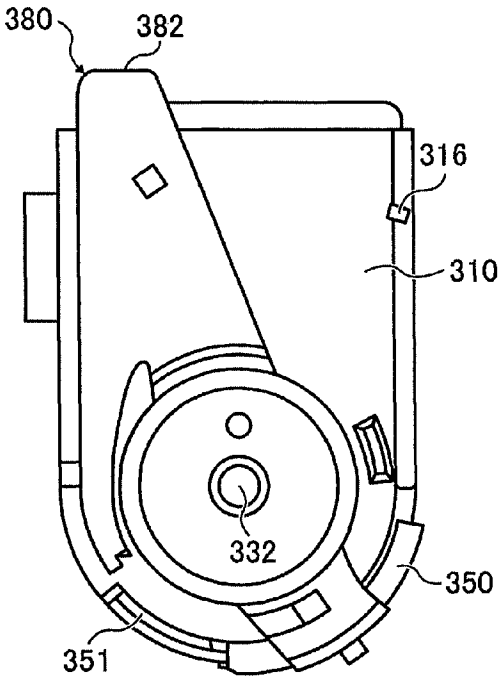
FIGS. 7A to 7C illustrate movement of an operating member of the storage container according to the exemplary embodiment of the invention, and specifically.
Figure 7B:
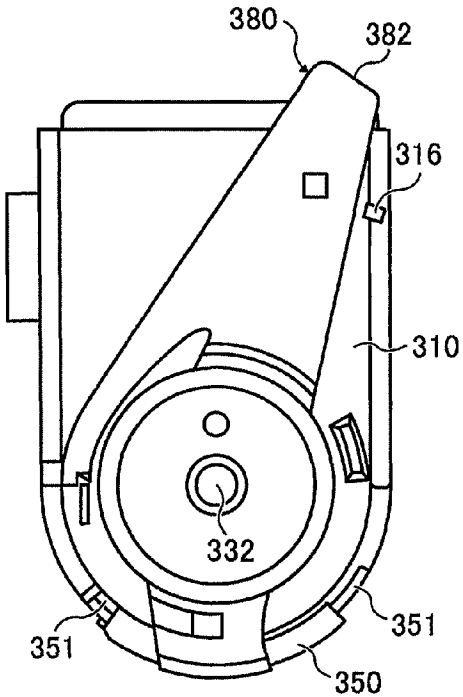
Figure 7C:
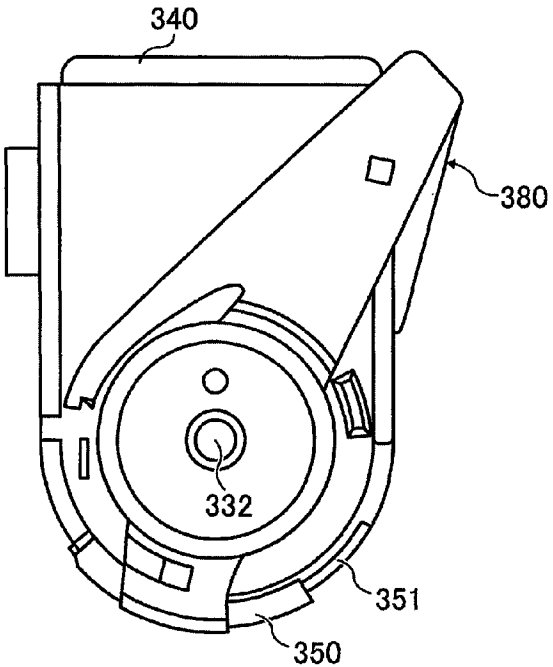
Figure 8C:
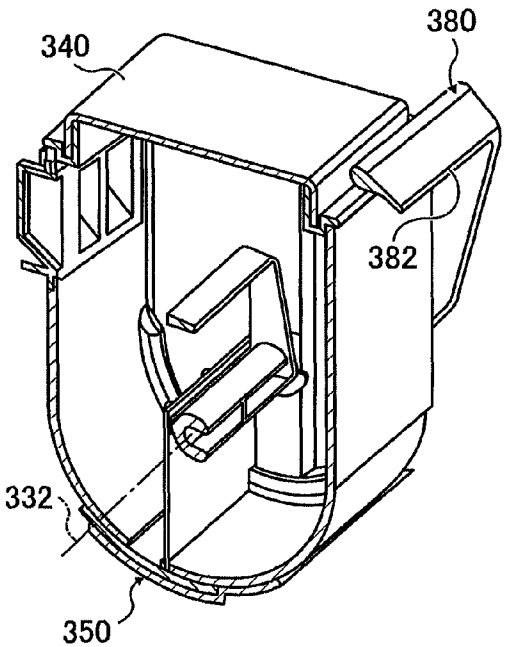
FIG. 8C is a side view showing a state where the operating member is in a third position.
Figure 8B:
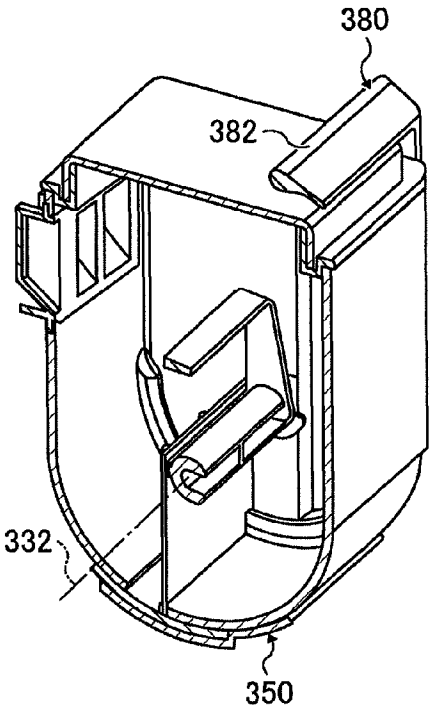
Figure 8A:
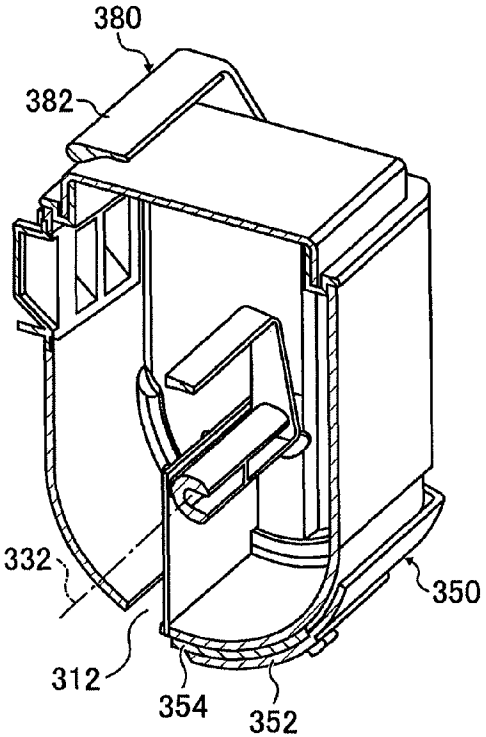

The operating member 380 can be moved between the first position shown in FIGS. 7A and 8A, the second position shown in FIGS. 7B and 8B, and the third position shown in FIGS. 7C and 8C.

The first position shown in FIGS. 7A and 8A is a position where the discharge hole 312 formed in the container body 310 is brought into the opened state. That is, when the operating member 380 is located in the first position, the opening and closing part 350 connected with the operating member 380 is brought into a state of being arranged in a position apart from the discharge hole 312. When the storage container 300 is mounted to the image forming apparatus body 20 so as to supply the toner to the developing device 110, the operating member 380 is operated so as to be brought into the state of being arranged in the first position.

The second position shown in FIGS. 7B and 8B is a state where the discharge hole 312 is closed and the facing portion 382 of the operating member 380 is arranged in a position where the facing portion 382 overlaps the filling hole 314 in the direction (vertical direction in this exemplary embodiment) along which the storage container 300 is filled with toner. When the operating member 380 is located in the second position, the opening and closing part 350 connected with the operating member 380 is brought into a state of being arranged in the position where the opening and closing part covers the discharge hole 312 and the discharge hole 312 is brought into a state of being blocked.

The third position shown in FIGS. 7C and 8C is a state where the discharge hole 312 is closed and the facing portion 382 of the operating member 380 is arranged in a position where the facing portion 382 does not overlap the filling hole 314 in the direction (vertical direction in this exemplary embodiment) along which the storage container 300 is filled with toner. When the operating member 380 is located in the third position, the opening and closing part 350 connected with the operating member 380 is brought into a state of being arranged in the position where the opening and closing part covers the discharge hole 312 and the discharge hole 312 is brought into a state of being blocked. Since the operating member 380 and the opening and closing part 350 are connected together, when the operating member 380 is moved to the third position from the second position, the opening and closing part 350 also moves in conjunction with the movement of the operating member 380. However, since the size of the opening and closing part 350 is formed to be larger than that of the discharge hole 312, the opening and closing part 350 moves with the discharge hold 312 being blocked, i.e., in a state where the sealing member 354 of the opening and closing part 350 seals the discharge hole 312. Also, when the operating member 380 is located in the third position, the facing portion 382 is brought into the state where the facing portion 382 does not overlap the filling hole 314 in the vertical direction that is the direction along which the container body 310 is filled with toner.

In addition, in order for the opening and closing part 350 to move with respect to the container body 310, the container body 310 is provided with an opening and closing part guide groove 351 which serves as a guide part which guides the opening and closing part 350. The opening and closing part guide groove 351 is provided so as to extend in both the opening and closing directions of the opening and closing part 350, i.e., not only in the opening direction of the opening and closing part 350 but also in the closing direction of the opening and closing part 350, when the opening and closing part 350 is located in the second position. When the opening and closing part 350 is moved between the second position and the third position, the opening and closing part 350 is guided by the opening and closing part guide groove 351 while being kept in a state where the sealing member 354 of the opening and closing part 350 seals the discharge hole 312.

When it is attempted to mount the storage container 300 to the image forming apparatus body 20 in a state where the operating member 380 is located at the third position, the operating member 380 and the image forming apparatus body 20 interfere with each other. That is, the operating member 380 is used as an interference part which interferes with the image forming apparatus body 20 when the storage container 300 is mounted to the image forming apparatus body 20 in the state where the operating member 380 is located in the third position.

When the operating member 380 is located in the third position and toner is filled into the container body 310, the facing portion 382 hardly hinders movement (falling) of the toner. After the operating member 380 is arranged in the third position and toner is filled into the container body 310, the filling hole 314 of the container body 310 is closed by the lid member 340.

Figure 9:
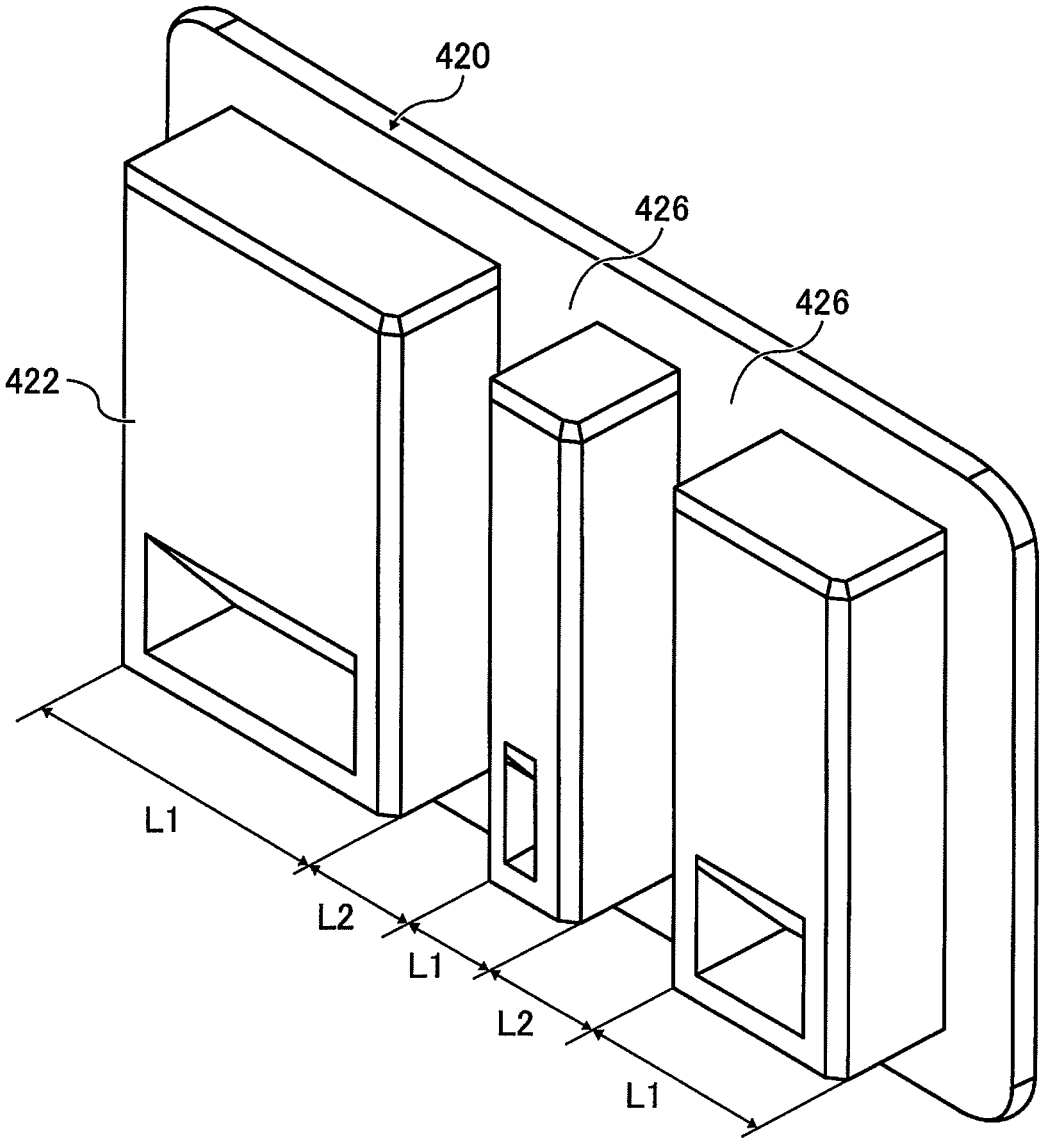
FIG. 9 is a first perspective view showing a convex portion forming member used in the storage container according to the exemplary embodiment of the invention.
Figure 10:
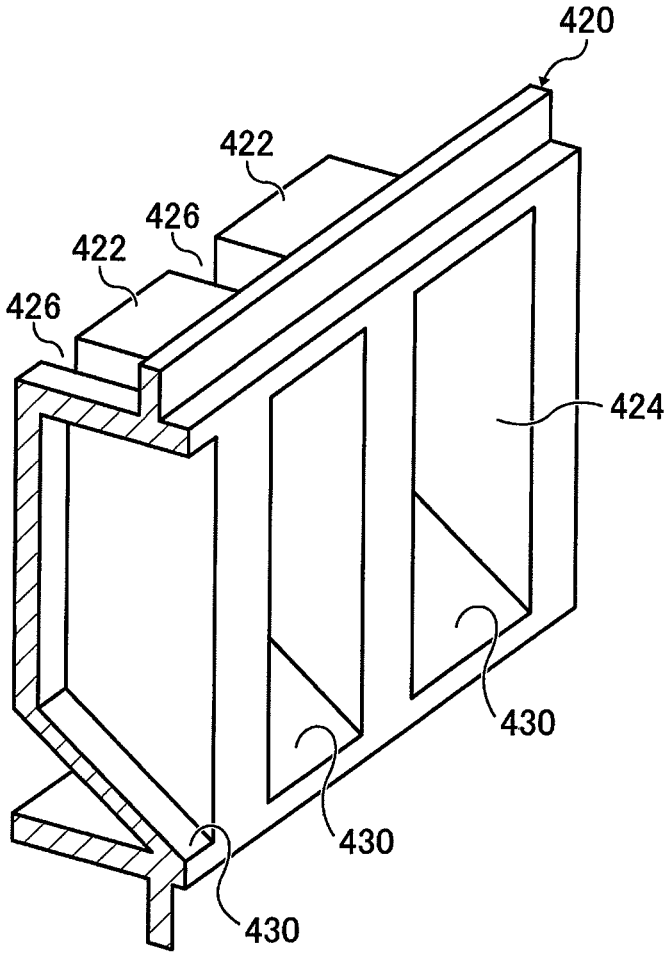
FIG. 10 is a second perspective view showing the convex portion forming member used in the storage container according to the exemplary embodiment of the invention.
Figure 11:
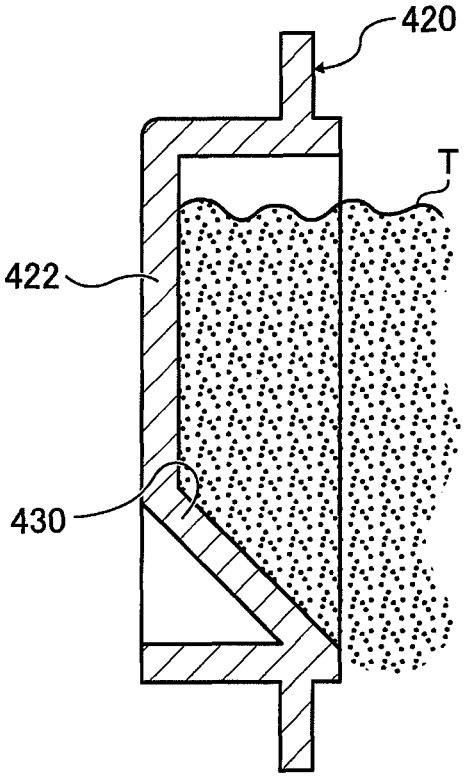
FIG. 11 is a section view showing the convex portion forming member used in the storage container according to the exemplary embodiment of the invention.

FIGS. 9 to 11 show the protruding portion forming members 420. The protruding portion forming members 420, as mentioned above, are used to constitute the container-side protruding portion 422, and are mounted to the container body 310. The container-side protruding portions 422 are formed so as to protrude toward the outside of the container body 310 (see FIG. 4), and cavities 424 are formed on the storage chamber 302 side. As shown in FIG. 11, the cavities 424 are used for storage of toner T, along with the storage chamber 302.

At least two container-side protruding portions 422 are formed. When the storage container 300 is mounted to the image forming apparatus body 20, a body-side protruding portion 38 (see FIG. 12) on the image forming apparatus body 20 fits into a concave portion 426 that is a space formed between the two container-side protruding portions 422, which are adjacent to each other. The body-side protruding portion(s) 38 will be described below in detail.

In this exemplary embodiment, three container-side protruding portions 422 are formed, and two concave portions 426 are formed between the container-side protruding portions 422, which are adjacent to each other. However, the number of container-side protruding portions 422 is arbitral so long as at least two container-side protruding portions 422 are formed. For example, two container-side protruding portions 422 may be provided. In this case, one concave portion 426 is formed. Also, for example, four container-side protruding portions 422 may be provided. In this case, three concave portions 426 are formed.

The container-side protruding portions 422 are formed so that at least any one of the number, position, and shape of the concave portions 426 differs according to the type of toner stored in the storage chamber 302. For example, the case where a yellow toner is stored, the case where a magenta toner is stored, the case where a cyan toner is stored, and the case where a black toner is stored are different in at least one of the number, position, and shape of the concave portions 426. Also, for example, even when the same yellow toner is stored, for example when toners having different characteristics used for different types of models are stored, the concave portions 426 are formed so that the storage containers 300 in which toners having different characteristics are stored are different in at least one of the number, position, and width of the concave portions 426.

A total volume of the at least two formed container-side protruding portions 422 becomes larger than that of the concave portions 426. As shown in FIG. 9, for example, when the depth of the concave portions 426 is the same as the depth of the container-side protruding portions 422, a total length L1 in the width direction of the container-side protruding portions 422 is larger than a total length L2 in the width direction of the concave portions 426. Therefore, as compared with the case where the total length L1 in the width direction of the container-side protruding portions 422 is smaller than the total length L2 in the width direction of the concave portions 426, an amount of toner stored in the cavity 424 increases without increase in volume substantially occupied within the image forming apparatus body 20 by the container-side protruding portions 422.

Slopes 430 which face the storage chamber 302 are formed on the storage chamber 302 side of the container-side protruding portions 422, i.e., on a side where the cavities 424 are formed. The toner stored in the cavities 424 moves to the storage chamber 302 smoothly so as to slide down along the slopes 430. Therefore, the toner hardly remains in the cavities 424.

Also, printing or the like, which allows an operator or the like to identify the type of a toner to be filled or toner already filled, is formed on the protruding portion forming member 420. This printing or the like is arranged in a position which can be viewed in a state where the operating member 380 is arranged at least at a second position which will be described later. Also, this printing or the like is also arranged on the operating member 380 or the upper face of a lid member 340 which will be described later.

In the above description, in order to form the container-side protruding portions 422, the container-side protruding portions 422 are formed in the protruding portion forming member 420, and the protruding portion forming portions 422 are mounted to the container body 310. However, instead of mounting the protruding portion forming member 420 to the container body 310, the shape of the container body 310 may be formed so that the container body 310 itself constitutes the container-side protruding portions 422.

Figure 12:
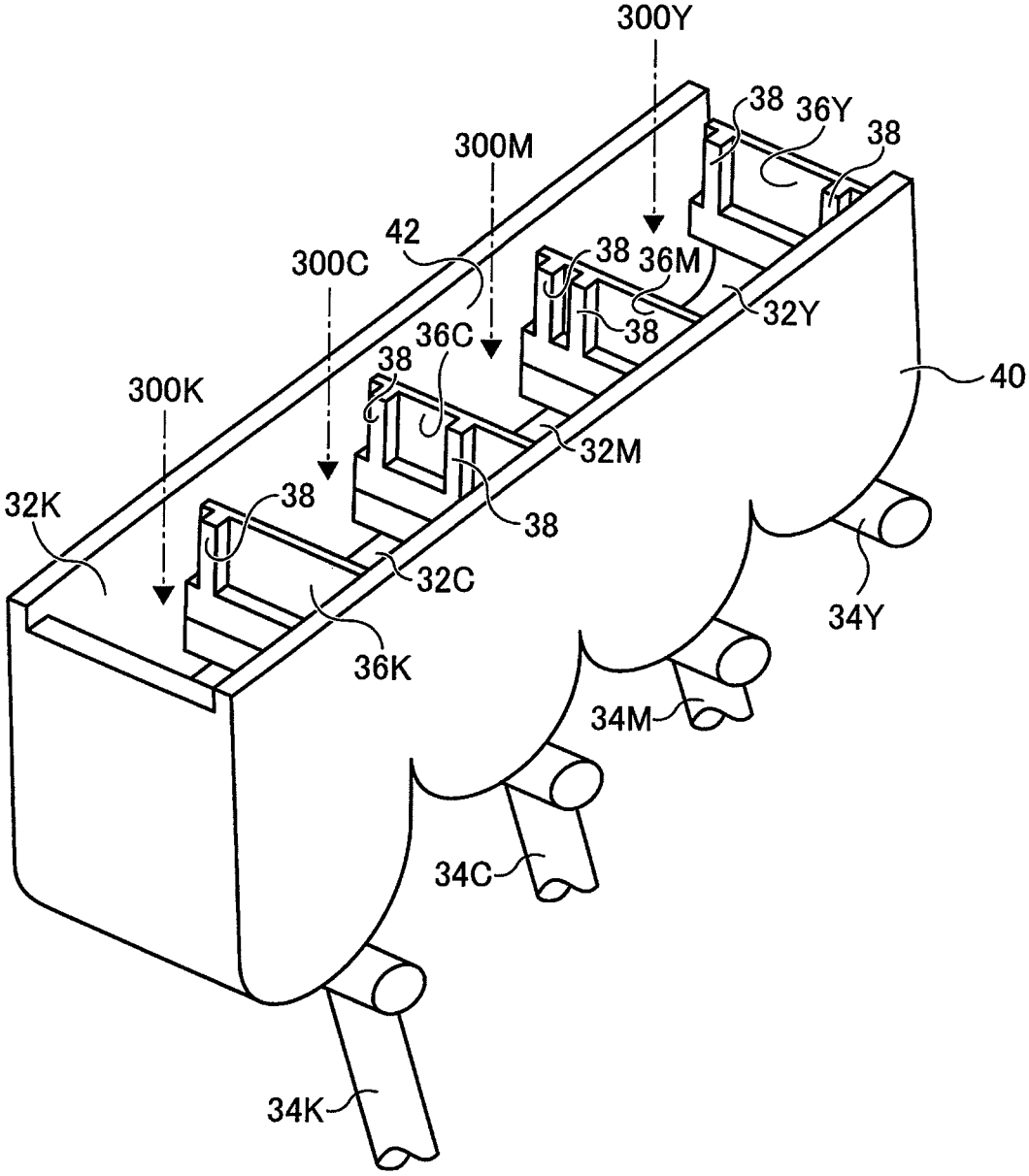
FIG. 12 is a first perspective view showing a mounting part which is formed in an apparatus body of the image forming apparatus according to the exemplary embodiment of the invention and which is mounted with the storage container.
Figure 14:
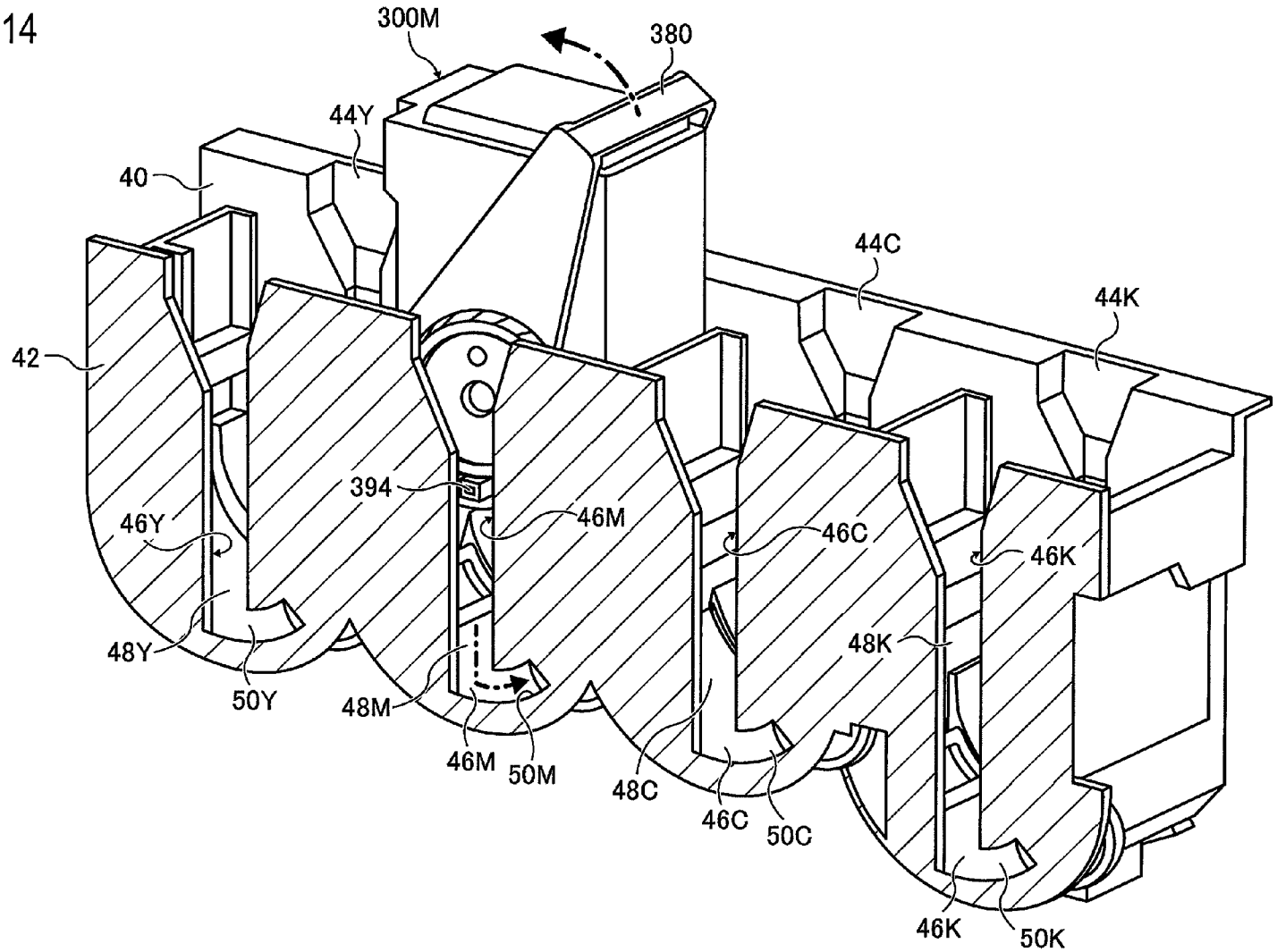
FIG. 14 is a second perspective view showing the mounting part which is formed in the apparatus body of the image forming apparatus according to the exemplary embodiment of the invention and which is mounted with the storage container.

FIG. 12 is a perspective view of the mounting device 30, and FIG. 14 is a schematic diagram showing a state where the storage container 300 is mounted to the mounting device 30.

As shown in FIG. 12, the mounting device 30 has a front side plate 40, a rear side plate 42, and connecting plates 36Y, 36M, 36C, and 36K which connects the front side plate 40 with the rear side plate 42, and mounting chambers 32Y, 32M, 32C, and 32K whose tops are opened and which are respectively formed by these members. The storage containers 300Y, 300M, 300C, and 300K are respectively mounted to the mounting chambers 32Y, 32M, 32C, and 32K from above.

Toner conveyance passages 34Y, 34M, 34C, and 34K are attached to lower portions of the mounting chambers 32Y, 32M, 32C, and 32K. The toner conveyance passages 34Y, 34M, 34C, and 34K are used to convey the toner in the storage containers 300Y, 300M, and 300C, and 300K to the developing devices 110Y, 110M, 110C, and 110K, respectively.

One or plural body-side protruding portion 38 are formed in the connecting plates 36Y, 36M, 36C, and 36K. The body-side protruding portion(s) 38 are formed to have such sizes and positions that the body-side protruding portion(s) 38 can be fitted into the concave portion(s) 426 (see FIGS. 9 to 11) provided in the storage container 300 to be mounted to each mounting chamber 32. For example, the body-side protruding portions 38 are formed on the mounting chamber 32Y so as to fit into the concave portions 426 formed in the yellow storage container 300Y which is to be mounted to the mounting chamber 32Y. As mentioned above, the positions of the concave portions 426 formed in the storage container 300 differ depending on, for example, the type of the toner stored in the storage container 300, such as the color of the toner. Therefore, the correct storage container 300 to be mounted to a specific mounting chamber 32 can be mounted to the mounting chamber 32. However, even if an attempt is made to mount a storage container 300 which is not the storage container 300 to be housed in the mounting chamber 32 and in which a different type of toner is stored, the container-side protruding portion 422 of the storage container 300 and the body-side protruding portion 38 of the protruding portion forming member 420 interfere with each other, so that the storage container 300 cannot be mounted to the mounting chamber 32.

Figure 13:
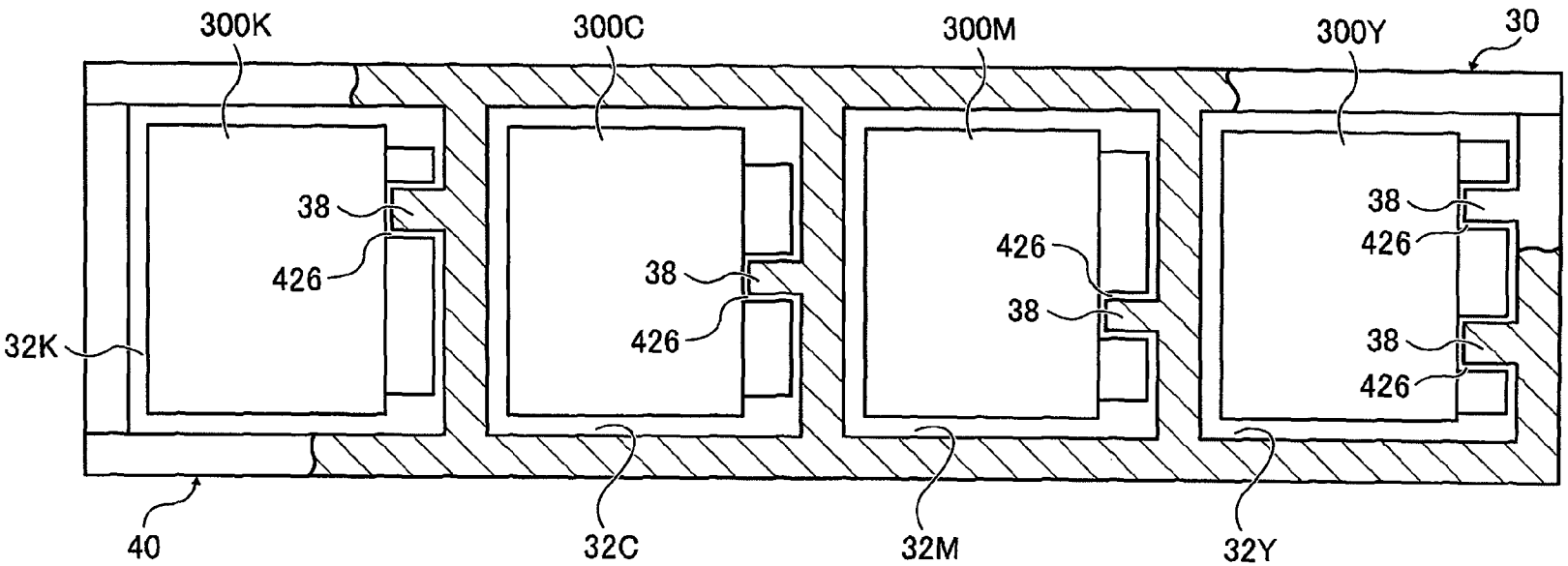
FIG. 13 is a schematic view illustrating a state where the storage container is mounted to an image forming apparatus body, in the image forming apparatus according to the exemplary embodiment of the invention.

That is, as shown in FIG. 13, when the storage container 300Y is mounted to the mounting chamber 32Y, the storage container 300M is mounted to the mounting chamber 32M, the storage container 300C is mounted to the mounting chamber 32C, and the storage container 300K is mounted to the mounting chamber 32K, the body-side protruding portion(s) 38 is fitted into the concave portion(s) 426 formed in each storage container 300, and each storage container 300 is mounted to the corresponding mounting chamber 32 well. On the other hand, if a storage container 300 which is not one which should be mounted to a specific mounting chamber 32 is mounted to the mounting chamber 32, the container-side protruding portion 422 and the body-side protruding portion 38 interfere with each other, so that the storage container 300 cannot be mounted.

FIG. 14 is a section view of the mounting device 30.

As shown in FIG. 14, four guide grooves 44Y, 44M, 44C, and 44K are formed in the front side plate 40 of the mounting device 30. The guiding projections 402 (see FIG. 4) are respectively fitted into the guide grooves 44Y, 44M, 44C, and 44K, and guide mounting of the storage containers 300Y, 300M, 300C, and 300K, when the storage containers 300Y, and 300M, 300C and 300K are respectively mounted to the mounting chambers 32Y, 32M, 32C, and 32K.

Four guide grooves 46Y, 46M, 46C, and 46K are formed in the rear side plate 42. The guiding projections 394 (see FIG. 3) are fitted into each of the guide grooves 46Y, 46M, 46C, and 46K, and guide the mounting of each of the storage containers 300Y, 300M, 300C, and 300K to the mounting chambers 32, when the storage containers 300Y, and 300M, 300C and 300K are respectively mounted to the mounting chambers 32Y, 32M, 32C, and 32K. Each guide groove 46 has a mounting direction guide portion 48 which has a wide entrance side, gets narrower gradually in the mounting direction of the storage container 300, and then has the same width, and a circular-arc portion 50 which extends in a substantially circular-arc shape from an end of the mounting direction guide portion 48 at a deep side thereof. When the operating member 380 is operated so as to move to the first position after the storage container 300 is mounted to the mounting chamber 32, the guiding projection 402 enters the circular-arc portion 50.

Each circular-arc portion 50 is used as a prohibition member which prohibits the storage container 300 from removed from the image forming apparatus body 20 in a state where the operating member 380 is arranged in the first position. That is, even if the guiding projection 394 enters the circular-arc portion 50, and the storage container 300 is lifted up so as to remove the storage container 300 in the state where the operating member 380 is arranged in the first position, the guiding projection 394 interferes with a portion of the rear side plate 42 which constitutes the circular-arc portion 50 so that the storage container 300 cannot be removed from the image forming apparatus body 20.

Figure 15B:
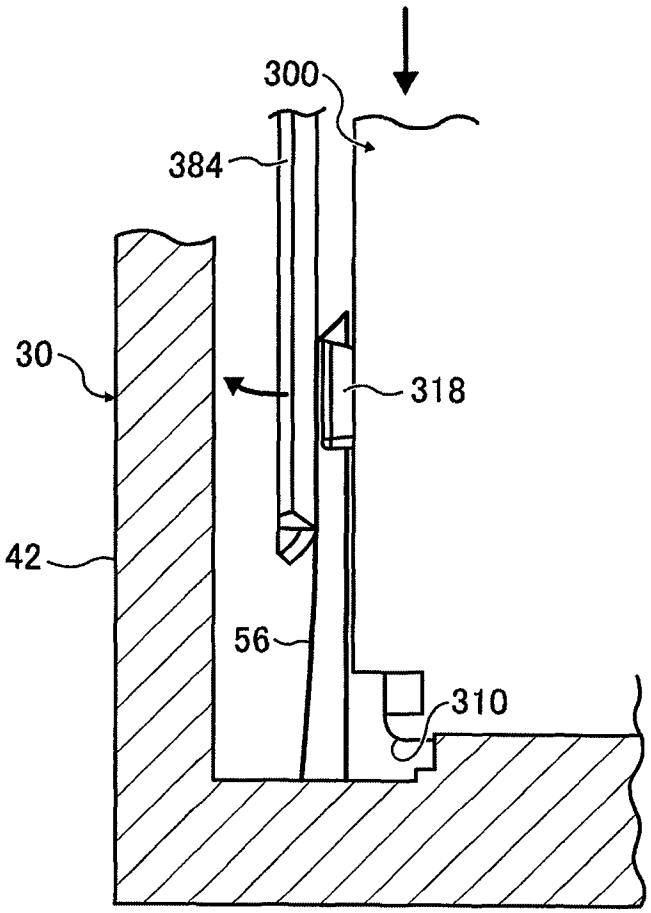
FIGS. 15A and 15B illustrate that the storage container is being mounted to a mounting device.
Figure 15A:
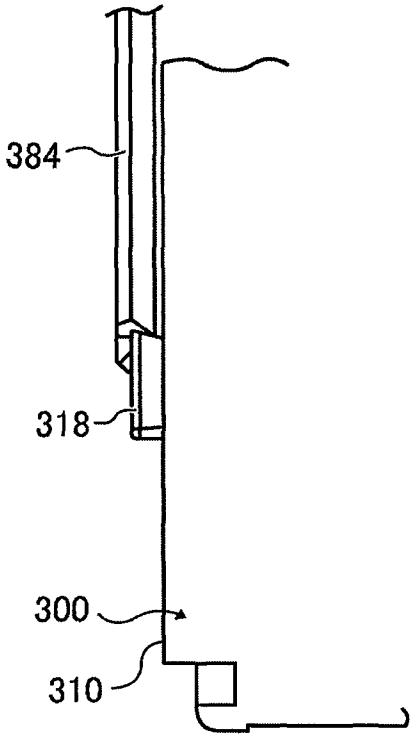

FIGS. 15A and 15B illustrate that the storage container 300 is mounted to the mounting device 30, FIG. 15A is a right side view of the storage container 300 in a state where the operating member 380 is arranged in the second position, and FIG. 15B is a view showing the right side face of the storage container 300 and a cross-section of the mounting device 30.

As shown in FIG. 15A, when the storage container 300 is not mounted on the image forming apparatus body 20, the prohibiting projection 318 (also see FIG. 5) is located in a position where the projection 318 interferes with a locus of movement of the front arm portion 384 in a state where the operating member 380 is arranged in the second position, so that the operating member 380 cannot be moved to the first position from the second position.

On the other hand, when the storage container 300 is inserted into the image forming apparatus body 20, as shown in FIG. 15B, an insertion member 56, which is provided so as to project upward from a bottom face of the mounting device 30, is inserted between the container body 310 and the front arm portion 384, and the front arm portion 384 deforms in a direction away from the container body 310 and moves to a position where the front arm portion 384 does not interfere with the prohibiting projection 318. Therefore, if the storage container 300 is mounted to the image forming apparatus body 20, the operating member 380 can be moved from the second position to the first position.

In the exemplary embodiment described above, a form in which the container is filled with the toner made of powder serving as an example of an image forming agent has been described. However, the invention is applicable to the case where a container is filled with, for example, ink in liquid form or the like.

Also, in the exemplary embodiments described above, the case has been described where a printer is used as an example of an image forming apparatus. However, the image forming apparatus of the invention includes other single-function apparatuses which performs a process using an image forming agent, such as a copying machine and a facsimile, or other apparatuses which have plural functions, such as a printer and a scanner, and which perform a process using an image forming agent. The invention is also applicable to these image forming apparatuses. Also, the image forming apparatus of the invention also includes apparatuses, such as visual equipment, such as a television, a DVD player, and an HDD, into which components which form an image using an image forming agent are incorporated, and the invention can be applied to these image forming apparatuses. Also, the image forming apparatus of the invention also includes apparatuses which are incorporated into, for example, a desk, a shelf, a wall, etc., and which form an image using an image forming agent, and the invention can be applied to these image forming apparatuses.

As described above, the invention is applicable to an image forming agent storage container, an image forming apparatus, a method of mounting the image forming agent storage container, a method of removing the image forming agent storage container, and a method of filling the image forming agent.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

DESCRIPTION OF REFERENCE NUMERALS AND SIGNS

10: IMAGE FORMING APPARATUS
20: IMAGE FORMING APPARATUS BODY
30: MOUNTING DEVICE
38: BODY-SIDE PROTRUDING PORTION
100: IMAGE FORMING PART
300: STORAGE CONTAINER
302: STORAGE CHAMBER
310: CONTAINER BODY
420: PROTRUDING PORTION FORMING MEMBER
422: CONTAINER-SIDE PROTRUDING PORTION
424: CAVITY
426: CONCAVE PORTION
430: SLOPE

What is claimed is:

1. An image forming agent storage container comprising:

a container body configured to be detachably attached in an image forming apparatus body in a vertical direction, the container body that forms a storage chamber in which an image forming agent is stored; and at least two container-side protruding portions that are formed on a side face of the container body and protrude toward an outside of the container body and that have cavities on a storage-chamber side thereof, the cavities being configured to store the image forming agent, wherein the at least two container-side protruding portions are configured so that a body-side protruding portion that is formed on the image forming apparatus body is fitted between the at least two container-side protruding portions, which are adjacent to each other, wherein the at least two container-side protruding portions which are adjacent to each other are formed so that at least one of (i) a number, (ii) a positions, and (iii) a shape of space formed between the at least two container-side protruding portions depends on a type of the image forming agent stored in the storage chamber, wherein a total volume of the at least two container-side protruding portion which are adjacent to each other is larger than that of a space formed between the at least two container-side protruding portions, and wherein slopes are obliquely provided on faces, serving as lower-end faces when the storage container is installed, of the at least two-container side protruding portions so that the storage-chamber side thereof is located downward.

2. The image forming agent storage container according to claim 1, wherein a total volume of the at least two container-side protruding portions is larger than that of a space formed between the at least two container-side protruding portions, which are adjacent to each other.

3. The image forming agent storage container according to claim 2, wherein slopes that face the storage chamber are formed on a storage chamber side of the at least two container-side protruding portions.

4. The image forming agent storage container according to claim 1, wherein slopes that face the storage chamber are formed on a storage chamber side of the at least two container-side protruding portions.

5. The image forming agent storage container according to claim 1, wherein slopes that face the storage chamber are formed on a storage chamber side of the at least two container-side protruding portions.

6. The image forming agent storage container according to claim 1, wherein slopes that face the storage chamber are formed on a storage chamber side of the at least two container-side protruding portions.

7. The image forming agent storage container according to claim 1, wherein the at least two container-side protruding portions are formed so that at least one of (i) a number, (ii) a position, and (iii) a shape of space formed between the at least two container-side protruding portions depends on a type of the image forming agent stored in the storage chamber, and a total volume of the at least two container-side protruding portions is larger than that of a space formed between the at least two container-side protruding portions, which are adjacent to each other.

8. An image forming apparatus comprising:

an image forming apparatus body;

an image forming agent storage container configured to be detachably attached in the image forming apparatus body in a vertical direction, the image forming agent storage container that stores an image forming agent; and an image forming part that forms an image using the image forming agent stored in the image forming agent storage container, wherein the image forming agent storage container includes a container body configured to be detachably attached in the image forming apparatus body, the container body that forms a storage chamber in which the image forming agent is stored, and at least two container-side protruding portions that are formed on a side face of the container body and protrude toward an outside of the container body and that have cavities on a storage-chamber side thereof, the cavities being configured to store the image forming agent, and a body-side protruding portion that is formed on the image forming apparatus body is fitted between the at least two container-side protruding portions, which are adjacent to each other, wherein the at least two container-side protruding portions which are adjacent to each other are formed so that at least one of (i) a number, (ii) a positions, and (iii) a shape of space formed between the at least two container-side protruding portions depends on a type of the image forming agent stored in the storage chamber, wherein a total volume of the at least two container-side protruding portion which are adjacent to each other is larger than that of a space formed between the at least two container-side protruding portions, wherein slopes are obliquely provided on faces, serving as lower-end faces when the storage container is installed, of the at least two-container side protruding portions so that the storage-chamber side thereof is located downward.

9. The image forming apparatus according to claim 8, wherein the at least two container-side protruding portions are formed so that at least one of (i) a number, (ii) a position, and (iii) a shape of space formed between the at least two container-side protruding portions depends on a type of the image forming agent stored in the storage chamber, and a total volume of the at least two container-side protruding portions is larger than that of a space formed between the at least two container-side protruding portions, which are adjacent to each other.

10. A method for mounting an image forming agent storage container, the method comprising:

mounting the image forming agent storage container in an image forming apparatus body in a vertical direction so that a body-side protruding portion that is formed on the image forming apparatus body is fitted between at least two container-side protruding portions of the image forming agent storage container which are adjacent to each other, wherein the image forming agent storage container includes a container body configured to be detachably attached in the image forming apparatus body, the container body that forms a storage chamber in which an image forming agent is stored, the at least two container-side protruding portions are formed on a side face of the container body and protrude toward an outside of the container body and have cavities on a storage-chamber side thereof, the cavities being configured to store the image forming agent, wherein the at least two container-side protruding portions which are adjacent to each other are formed so that at least one of (i) a number, (ii) a positions, and (iii) a shape of space formed between the at least two container-side protruding portions depends on a type of the image forming agent stored in the storage chamber, and wherein a total volume of the at least two container-side protruding portion which are adjacent to each other is larger than that of a space formed between the at least two container-side protruding portions.

11. The method according to claim 10, wherein the at least two container-side protruding portions are formed so that at least one of (i) a number, (ii) a position, and (iii) a shape of space formed between the at least two container-side protruding portions depends on a type of the image forming agent stored in the storage chamber, and a total volume of the at least two container-side protruding portions is larger than that of a space formed between the at least two container-side protruding portions, which are adjacent to each other.

12. A method for removing an image forming agent storage container, the method comprising:

removing the image forming agent storage container, which is mounted in an image forming apparatus body in a vertical direction so that a body-side protruding portion formed on the image forming apparatus body is fitted between at least two container-side protruding portions of the image forming agent storage container which are adjacent to each other, from the image forming apparatus body so that the body-side protruding portion is removed from between the at least two container-side protruding portions, which are adjacent to each other, wherein the image forming agent storage container includes a container body configured to be detachably attached in the image forming apparatus body, the container body that forms a storage chamber in which an image forming agent is stored, the at least two container-side protruding portions are formed on a side face of the container body and protrude toward an outside of the container body and have cavities on a storage-chamber side thereof, the cavities being configured to store the image forming agent, wherein the at least two container-side protruding portions which are adjacent to each other are formed so that at least one of (i) a number, (ii) a positions, and (iii) a shape of space formed between the at least two container-side protruding portions depends on a type of the image forming agent stored in the storage chamber, and wherein a total volume of the at least two container-side protruding portion which are adjacent to each other is larger than that of a space formed between the at least two container-side protruding portions.

13. The removing method according to claim 12, wherein the at least two container-side protruding portions are formed so that at least one of (i) a number, (ii) a position, and (iii) a shape of space formed between the at least two container-side protruding portions depends on a type of the image forming agent stored in the storage chamber, and a total volume of the at least two container-side protruding portions is larger than that of a space formed between the at least two container-side protruding portions, which are adjacent to each other.

14. A method for filling an image forming agent into an image forming agent storage container, the method comprising:

filling the image forming agent into the image forming agent storage container so that at least portions of cavities are filled with the image forming agent, wherein the image forming agent storage container includes a container body configured to be detachably attached in an image forming apparatus body in a vertical direction, the container body that forms a storage chamber in which the image forming agent is to be stored, and at least two container-side protruding portions that are formed on a side face of the container body and protrude toward an outside of the container body and that have the cavities on a storage-chamber side thereof, the cavities being configured to store the image forming agent, and the at least two container-side protruding portions are configured so that a body-side protruding portion that is formed on the image forming apparatus body is fitted between the at least two container-side protruding portions, which are adjacent to each other, wherein the at least two container-side protruding portions which are adjacent to each other are formed so that at least one of (i) a number, (ii) a positions, and (iii) a shape of space formed between the at least two container-side protruding portions depends on a type of the image forming agent stored in the storage chamber, wherein a total volume of the at least two container-side protruding portion which are adjacent to each other is larger than that of a space formed between the at least two container-side protruding portions, wherein slopes are obliquely provided on faces, serving as lower-end faces when the storage container is installed, of the at least two-container side protruding portions so that the storage-chamber side thereof is located downward.

15. The filling method according to claim 14, wherein the at least two container-side protruding portions are formed so that at least one of (i) a number, (ii) a position, and (iii) a shape of space formed between the at least two container-side protruding portions depends on a type of the image forming agent stored in the storage chamber, and a total volume of the at least two container-side protruding portions is larger than that of a space formed between the at least two container-side protruding portions, which are adjacent to each other.

* * * * *